United States Patent [19]

Nesbit et al.

[11] Patent Number: 4,904,988

[45] Date of Patent: Feb. 27, 1990

[54] TOY WITH A SMOKE DETECTOR

[76] Inventors: Charles E. Nesbit, 9206 Willard Ct., Des Moines, Iowa 50322; Mark S. Nesbit, 1248 17th, West Des Moines, Iowa 50265

[21] Appl. No.: 319,616

[22] Filed: Mar. 6, 1989

[51] Int. Cl.[4] ..... G08B 17/10

[52] U.S. Cl. ..... 340/628; 340/539; 340/691; 340/693; 340/584; 379/43; 446/71; 446/72; 446/81; 446/76; 446/175; 446/404

[58] Field of Search ..... 446/14, 24, 25, 71, 446/72, 73, 75, 76, 81, 175, 404, 491, 219; 340/693, 691, 628-630, 584, 577, 586, 590, 539; 250/574, 573, 575, 578; 356/439; 379/43

[56] References Cited

U.S. PATENT DOCUMENTS

| | | | |
|---|---|---|---|
| 2,877,453 | 3/1959 | Mendenhall, Jr. | 340/628 |
| 3,771,192 | 11/1973 | Zaleski | 15/330 |
| 3,863,076 | 1/1975 | Steele et al. | 250/574 |
| 3,936,814 | 2/1976 | Muller-Girard et al. | 340/237 |
| 3,978,461 | 8/1976 | DeLime, III | 340/227 |
| 4,004,288 | 1/1977 | Webb, Jr. | 340/237 |
| 4,075,614 | 2/1978 | White | 340/590 |
| 4,186,389 | 1/1980 | Flittie | 340/628 |
| 4,186,390 | 1/1980 | Enemark | 340/630 |
| 4,219,806 | 8/1980 | Enemark | 340/632 |
| 4,245,429 | 1/1981 | Katzman et al. | 46/164 |
| 4,302,753 | 11/1981 | Conforti | 340/628 |
| 4,316,179 | 2/1982 | Bliss et al. | 340/310 A |
| 4,316,184 | 2/1982 | Nagel | 340/628 |
| 4,404,550 | 9/1983 | Shaw | 340/628 |
| 4,423,411 | 12/1983 | van der Walt et al. | 340/629 |
| 4,432,041 | 2/1984 | Pfisterer et al. | 362/86 |
| 4,456,907 | 6/1984 | Johnson | 340/629 |
| 4,531,114 | 7/1985 | Topol et al. | 340/628 |
| 4,659,919 | 4/1987 | Price | 250/209 |
| 4,740,186 | 4/1988 | Sirota | 446/14 |

FOREIGN PATENT DOCUMENTS

| | | | |
|---|---|---|---|
| 2184546 | 6/1987 | United Kingdom | 340/623 |

OTHER PUBLICATIONS

"Heath's HERO-1 Robot"; *Byte Publications Inc.*, p. 86, Jan. 83; Leininger.

*Primary Examiner*—Joseph A. Orsino
*Assistant Examiner*—Jill Jackson
*Attorney, Agent, or Firm*—Henderson & Sturm

[57] ABSTRACT

A toy that is equipped with a smoke detector that would be extremely portable and thus provide fire and smoke protection wherever you had the toy. The smoke detector is housed inside the toy with smoke sensing openings in several locations. The power supply is electronically coupled to the smoke detector by wires run on the inside of the toy.

31 Claims, 2 Drawing Sheets

TOY WITH A SMOKE DETECTOR

TECHNICAL FIELD

This invention relates to fire safety devices and more particularly to toys housing an alarm signal activiated by the detection of a fire condition in the vicinity of the toy.

BACKGROUND ART

There are many prior art devices related to smoke detectors of all types. And it is a documented fact that smoke detectors save many lives by providing an early warning system. One problem associated with smoke detectors is that they are normally permanently mounted and thus are only capable of providing a warning signal in the general area of where they are attached. Another problem associated with smoke detectors are that a lot of dwellings are not equipped with properly functioning smoke detectors and worse yet, many dwellings are not even equipped with smoke detectors at all.

Those concerned with these and other problems recognize the need for an improved toy equipped with a smoke detector.

DISCLOSURE OF THE INVENTION

The present invention provides a toy having a hollow interior in which an alarm signal is installed. Most generally a smoke detector having an alarm signal would be installed in an easily carried doll, stuffed toys and stuffed animals. The main portion of the smoke detector would be housed in a protected and not easily accessed location. The smoke detection sensors would normally be mounted in the general head area of the toy to provide for the best smoke reception without much worry of the smoke detectors sensors being covered up by a child sleeping with the toy. The battery compartment would be easily accessible inside the toy yet would be housed in a child proof container.

In another embodiment the toy would be equipped with an emergency light interconnected with the smoke detector and would only function in connection with the smoke alarm being activated. The emergency light's purpose would be to illuminate the child's path to safety.

An object of the present invention is the provision of an improved toy equipped with a smoke detector for an easily carried early warning fire protection device for children and adults.

Another object of the invention is to provide the child with an easily carried smoke detection toy that could be taken with them when they visited dwellings and structures helping to provide them with an early warning smoke detection system wherever they would go.

A further object of the invention is to provide a back up early warning smoke detection system in dwellings already equipped with smoke detectors.

Still another object is to provide a toy equipped with a smoke detector that would be sound interconnected with other permanently mounted smoke detectors by means of a built-in sound receiver in the toy that would pick up the audible sound of another smoke detector's alarm and would trigger the toy equipped with a smoke detector alarm to operate before smoke had even reached said toy and thus would provide an even earlier warning of a fire.

A still further object of the present invention is to interact with other toys equipped with smoke detectors by means of the alarm sound receivers built into the toy, thus providing smoke alarm protection for every room containing a toy equipped with a smoke detector that was in audible alarm receiving distance.

Yet another object is to provide the toy equipped with a smoke detector with a radio frequency transmitter and receiver.

Yet still another object would be to provide a toy equipped with a smoke detector that was electronically coupled with a relay that would allow the toy to give an alarm signal first and after a set time be able to give verbal instructions on what to do in a fire situation.

Yet a further object of the present invention is the provision of a toy equipped with a smoke detector that is easy to use, and inexpensive to manufacture.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
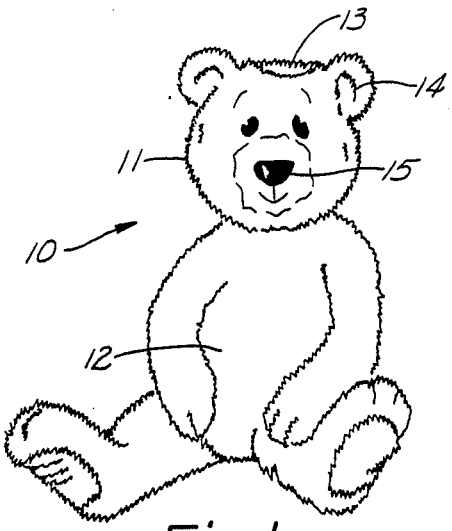
FIG. 1 is a perspective view of the toy equipped with a smoke detector.
Figure 2:
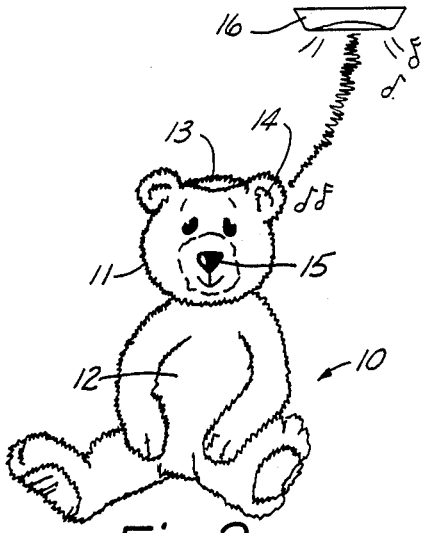
FIG. 2 is a perspective view of the toy equipped with a smoke detector interacting with a conventional ceiling mount smoke detector.
Figure 3:
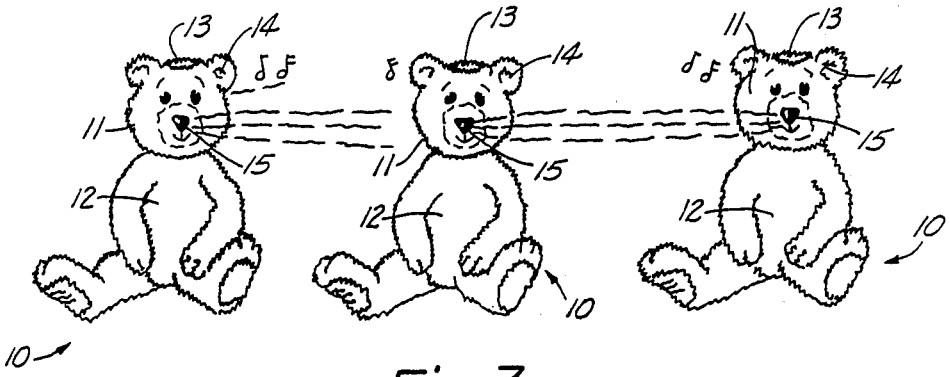
FIG. 3 is a perspective view of other toys equipped with a smoke detector interacting with each other.

Referring now to the drawings, wherein like reference numerals designate identical or corresponding parts throughout the several views, FIG. 1 shows a fire safety device (10). The embodiment of the fire safety device (10) includes a toy equipped with an alarm signal device. The toy shown is a stuffed animal or doll including a head (11), a body section (12), a smoke detector sensor (13), a sound receiver (14), and the smoke detector alarm transmitter (15) in the nose. Although the alarm signal device shown is part of a conventional smoke detector (16) which is activated by a fire condition such as smoke, combustion gas, heat or flame, it is to be understood that the alarm signal device could be an audio or visual alarm activated by sound or radio waves from other fire condition alarm devices. Also, it is to be understood that the conventional smoke detector (16) shown could be of the photoelectric type, ionization type, light reflective type, or optical type; and that they could be battery powered.

Figure 4:
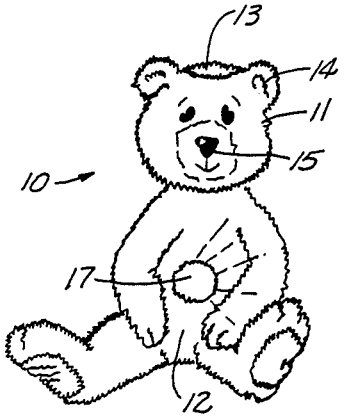
FIG. 4 is a front view of a toy equipped with a smoke detector and emergency light.

FIG. 4 shows a front view of a toy equipped with a alarm signal device with an interconnected emergency light (17).

Figure 5:
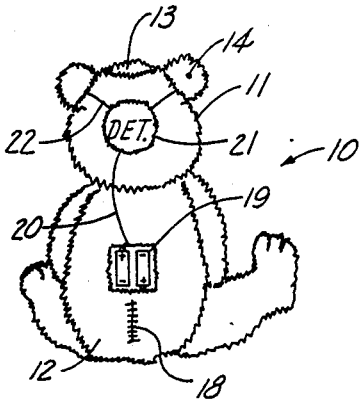
FIG. 5 is a cutaway rear view of the toy equipped with a smoke detector.

FIG. 5 shows a back view of the toy equipped with an alarm signal device, the zipper on the back (18), the inside battery compartment (19), the wiring (20) to the smoke detector (21) which is mounted in the head area (11), and the wiring (22) to the sound receivers (14).

Figure 6:
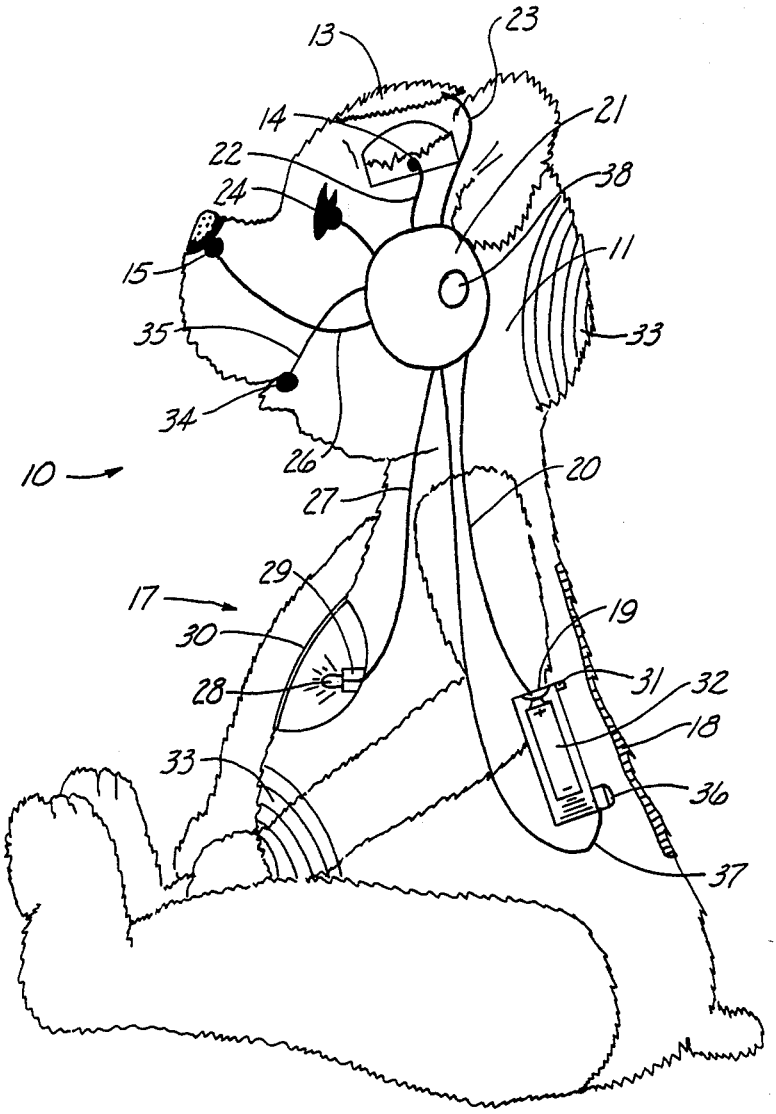
FIG. 6 is a cutaway side view showing the components that make up the fire safety device.

FIG. 6 shows a cutaway side view of the toy equipped with an alarm signal device. The smoke sensor (13) connects by a wire (23) to the smoke detector (21). The optic smoke sensor (24) connects by wire (25) to the smoke detector (21). The smoke alarm (15) connects by wire (26) to the smoke detector (21). The emergency light (17) interconnects with the smoke detector (21) by wire (27). The light bulb (28) plugs into the socket (29) and a clear lens (30) covers the entire emergency light (17). The battery compartment (19) has a childproof screw on cover (31). The battery (32) is shown inside the battery compartment (19). A zipper (18) opens up the toy for replacement of the battery (32) and the light bulb (28). Power is transported by wire (20) to the smoke detector (21). Padding (33) is located throughout the toy to protect the user and the electronics. The optional sound speaker (34) for voice instruction interconnects with the smoke detector (21) and the smoke detector's alarm (15). The sound speaker (34) connects to the system by wire (35). The test button (36) is mounted inside the toy on the battery compartment (19). When the smoke detectors test button (36) is pressed it connects by wire (37) to the smoke detector (21) and sounds the smoke alarm (15). The emergency telephone number calling device (38) interconnects with the alarm signal device.

Thus it can be seen that at least all of the stated objectives have been achieved.

Obviously, many modifications and variations of the present invention are possible in light of the above teachings. It is therefore to be understood that, within the scope of the appended claims, the invention may be practised otherwise than as specifically described.

We claim:

1. A fire safety device, comprising:

a portable toy including a body secton formed of pliable shock absorbent material, a hollow interior cavity surrounded by said body section, and an access opening in said body section communicating with said interior cavity;

an alarm signal device disposed within said interior cavity; wherein said alarm signal device emits an audible alarm having a sound output equivalent of at least about 70 decibels and means for activating said alarm signal device when a fire condition is detected in the vicinity of said toy.

2. The fire safety device of claim 1 further including an emergency light attached to the body section of said toy and being operably connected to and activated by said alarm signal device.

3. The fire safety device of claim 1 wherein said detected fire condition includes a sound emitted from a remote fire condition detector located remote from said toy.

4. The fire safety device of claim 1 further including an emergency telephone number calling device attached to the body section of said toy and being operably connected to and activated by said alarm signal device.

5. The fire safety device of claim 1 wherein said toy is a stuffed animal.

6. The fire safety device of claim 1 wherein said toy is a doll.

7. The fire safety device of claim 1 further including an audio message device attached to the body section of said toy and being operably connected to and activated by said alarm signal device.

8. The fire safety device of claim 7 wherein said audio message device emits verbal instructions recommending actions to be taken in a fire situation.

9. The fire safety device of claim 1 wherein said detected fire condition includes the presence of smoke, combustion gases, heat or flame.

10. The fire safety device of claim 9 wherein said alarm signal device is a battery powered smoke detector.

11. The fire safety device of claim 10 wherein said smoke detector is an ionization type.

12. The fire safety device of claim 10 further including means for warning a user of low battery power.

13. The fire safety device of claim 3 wherein said alarm signal device is a battery powered alarm activated by the sound from said remote fire condition detector.

14. The fire safety device of claim 13 wherein said remote fire condition detector is permanently mounted to a dwelling structure.

15. The fire safety device of claim 13 wherein said remote fire condition detector is portable.

16. The fire safety device of claim 1 wherein said detected fire condition includes a radio signal emitted from a remote fire condition detector located remote from said toy.

17. The fire safety device of claim 16 wherein said alarm signal device is a battery powered alarm activated by the radio signal from the remote fire condition detector.

18. The fire safety device of claim 17 wherein said remote fire condition detector is portable.

19. The fire safety device of claim 17 wherein said remote fire condition detector is permanently mounted to a dwelling structure.

20. A fire safety device, comprising:

a portable toy including a body section formed of pliable shock absorbent material, a hollow interior cavity surrounded by said body section, and an access opening in said body section communicating with said interior cavity;

an alarm signal device disposed within said interior cavity and, means for activating said alarm signal device when a fire condition is detected in the vicinity of said toy wherein said alarm signal device emits a visual alarm.

21. A fire safety device, comprising:

a portable toy including a body section formed of pliable shock absorbent material, a hollow interior cavity surrounded by said body section, and an access opening in said body section communicating with said interior cavity;

an alarm signal device disposed within said interior cavity;

means for activating said alarm signal device when a fire condition is detected in the vicinity of said toy; and, an emergency light attached to the body section of said toy and being operably connected to and activated by said alarm signal device.

22. A fire safety device, comprising:

a portable toy including a body section formed of pliable shock absorbent material, a hollow interior cavity surrounded by said body section, and an access opening in said body section communicating with said interior cavity;

an alarm signal device disposed within said interior cavity;

means for activating said alarm signal device when a fire condition is detected in the vicinity of said toy; and, an audio message device attached to the body section of said toy and being operably connected to and activated by said alarm signal device; wherein, said audio message device emits verbal instructions recommending actions to be taken in a fire situation.

23. A fire safety device, comprising:

a portable toy including a body section formed of pliable shock absorbent material, a hollow interior cavity surrounded by said body section, and an access opening in said body section communicating with said interior cavity;

an alarm signal device disposed within said interior cavity; and, means for activating said alarm signal device when a fire condition is detected in the vicinity of said toy wherein said detected fire condition detector located remote from said toy.

24. The fire safety device of claim 23 wherein said alarm signal device is a battery powered alarm activated by the sound from said remote fire condition detector.

25. The fire safety device of claim 24 wherein said remote fire condition detector is portable.

26. The fire safety device of claim 24 wherein said remote fire condition detector is permanently mounted to a dwelling structure.

27. A fire safety device, comprising:

a portable toy including a body section formed of pliable shock absorbent material, a hollow interior cavity surrounded by said body section, and an access opening in said body section communicating with said interior cavity;

an alarm signal device disposed within said interior cavity; and, means for activating said alarm signal device when a fire condition is detected in the vicinity of said toy wherein said detected fire condition includes a radio signal emitted from a remote fire condition detector located remote from said toy.

28. The fire safety device of claim 27 wherein said alarm signal device is a battery powered alarm activated by the radio signal from the remote fire condition detector.

29. The fire safety device of claim 28 wherein said remote fire condition detector is portable.

30. The fire safety device of claim 29 wherein said remote fire condition detector is permanently mounted to a dwelling.

31. A fire safety device, comprising:

a portable toy including a body section formed of pliable shock absorbent material, a hollow interior cavity surrounded by said body section, and an access opening in said body section communicating with said interior cavity;

an alarm signal device disposed within said interior cavity;

means for activating said alarm signal device when a fire condition is detected in the vicinity of said toy; and, an emergency telephone number calling device attached to the body section of said toy and being operably connected to and activated by said alarm signal device.

* * * * *